US006364970B1

(12) United States Patent
Hielscher et al.

(10) Patent No.: US 6,364,970 B1
(45) Date of Patent: Apr. 2, 2002

(54) DIECASTING ALLOY

(75) Inventors: Ulrich Hielscher; Horst Sternau; Hubert Koch, all of Rheinfelden (DE)

(73) Assignee: Aluminium Rheinfelden GmbH, Rheinfelden (DE)

( * ) Notice: Subject to any disclaimer, the term of this patent is extended or adjusted under 35 U.S.C. 154(b) by 0 days.

(21) Appl. No.: 08/342,695

(22) Filed: Nov. 21, 1994

(30) Foreign Application Priority Data

Jun. 16, 1994 (CH) ..... 01901/94

(51) Int. Cl.[7] ..... C22C 21/06
(52) U.S. Cl. ..... 148/440; 420/544; 420/546
(58) Field of Search ..... 148/440; 420/544, 420/546

(56) References Cited

U.S. PATENT DOCUMENTS

| | | | | |
|---|---|---|---|---|
| 3,726,672 A | | 4/1973 | Lindberg et al. | 420/530 |
| 4,104,089 A | | 8/1978 | Miki | 148/415 |
| 5,180,447 A | * | 1/1993 | Sigworth et al. | 420/552 |
| 5,250,125 A | * | 10/1993 | Koch et al. | 148/549 |

FOREIGN PATENT DOCUMENTS

| | | | |
|---|---|---|---|
| EP | 0301472 | | 2/1989 |
| EP | 0398449 | | 11/1990 |
| EP | 0539328 | | 4/1993 |
| JP | 58-42748 | * | 3/1983 |
| JP | 01-319646 | * | 12/1989 |
| JP | 05-208296 | * | 8/1993 |

OTHER PUBLICATIONS

Chemical Abstracts, vol. 93, No. 16, Oct. 20, 1980, Abstract No. 154266, by Balicki et al.

Chemical Abstracts, vol. 104, No. 12, Mar. 24, 1986, Abstract No. 93678, by Latkowski et al.

Chemical Abstracts, vol. 97, No. 18, Nov. 1, 1982 Abstract No. 148995, by Eshonov et al.

Patent Abstracts of Japan, vol. 7, No. 56, Mar. 8, 1983 for Japanese Patent Publication No. JP–A–57–207162.

Patent Abstract of Japan, vol. 14, No. 57, Feb. 2, 1990 for Japanese Patent Publication No. JP–A–01–283336.

Chemical Abstracts, vol. 116, No. 10, mar. 9, 1992, Abstract No. 89129, by Singh et al.

S.R. Lampman et al., Metals Handbook vol. 2, American Society for Metals, Metals Park, Ohio, USA 1990. pp. 131–133, 167–168.

A.C. Street, Diecasting Handbook, Protcullis Press, Redhill, U.K. 1986, pp. 155–158 643–645.

W. Hufnagel, Aluminum–Taschenbuch, Aluminum Verlag, Duesseldorf, Germany, 1983, pp. 1003–1004, 867–870.

* cited by examiner

*Primary Examiner*—Sikyn Ip
(74) *Attorney, Agent, or Firm*—Bachman & LaPointe, P.C.

(57) ABSTRACT

The diecasting alloy based on aluminium-silicon contains 9.5 to 11.5 w. % silicon
0.1 to 0.5 w. % magnesium
0.5 to 0.8 w. % manganese
max 0.15 w. % iron
max 0.03 w. % copper
max 0.10 w. % zinc
max 0.15 w. % titanium with the remainder aluminium and for permanent refinement 30 to 300 ppm strontium.

9 Claims, No Drawings

DIECASTING ALLOY

BACKGROUND OF THE INVENTION

The invention concerns a diecasting alloy based on aluminium-silicon.

The use of aluminium-silicon casting alloys to produce components in the diecasting process is generally known. Today, safety components in particular are subject to requirements which the known diecasting alloys cannot meet in all respects.

SUMMARY OF THE INVENTION

In view of these circumstances, the task of the inventors was to produce an aluminium diecasting alloy which meets the requirements imposed on safety components such as car wheels for example with regard to its mechanical properties both in the cast state and after heat treatment, is easy to weld and has a high corrosion resistance. In addition, the alloy should be easily castable.

DETAILED DESCRIPTION

The task is solved according to the invention by a diecasting alloy based on aluminium-silicon, which contains 9.5 to 11.5 weight percent silicon 0.1 to 0.5 weight percent magnesium 0.5 to 0.8 weight percent manganese max 0.15 weight percent iron max 0.03 weight percent copper max 0.10 weight percent zinc max 0.15 weight percent titanium and for the remainder aluminium and, for permanent refinement, 30 to 300 ppm strontium.

The diecasting alloy according to the invention thus corresponds to type AlSi9Mg with a considerably reduced iron content and a strontium refinement of the AlSi eutectic. Because of the high expansion values both in the cast state and after heat treatment, the alloy is particularly suitable for the production of safety components.

Although in its cast state the alloy has very good mechanical values, castings produced from the alloy according to the invention can be subjected to all heat treatments.

The mechanical properties achieved with heat treatment are largely dependent on the magnesium content. Therefore the tolerances are set very low in production. The magnesium content is adapted to the requirements for the casting.

To improve the forming properties, the alloy contains manganese. The relatively high proportion of eutectic silicon is refined by strontium. In comparison with granular diecasting alloys with higher impurities, the alloy according to the invention has advantages with regard to endurance limits. The fracture strength is higher because of the very low levels of mixed crystals and the refined eutectic.

The alloy according to the invention is preferably produced as a horizontal extruded casting. This makes it possible to melt a diecasting alloy with low oxide impurities without costly melt cleaning: an important requirement for achieving high expansion values in the casting.

On melting, any contamination of the melt in particular by copper or iron should be avoided. The permanently refined AlSiMg alloy according to the invention is preferably cleaned by means of circulation gas treatment with inert gases by means of impellers.

The strontium content preferably lies between 50 and 150 ppm and should not generally fall below 50 ppm otherwise the casting behaviour can deteriorate.

The invention can also contain 0.05 to 0.3 weight percent, in particular 0.15 to 0.20 weight percent zirconium.

For preference, grain refinement is carried out with the alloy according to the invention. For this gallium phosphide and/or indium phosphide may be added to the alloy in a quantity corresponding to 1 to 250 ppm, preferably 1 to 30 ppm phosphorus. In addition, alloys for grain refinement can also contain titanium and boron, where the titanium and boron are added via a pre-alloy with 1 to 2 weight percent titanium and 1 to 2 weight percent boron, the remainder aluminium. Here the pre-alloy preferably contains 1.3 to 1.8 weight percent titanium and 1.3 to 1.8 weight percent boron, and has a titanium/boron weight ratio of approx 0.8 to 1.2. The amount of pre-alloy in the alloy according to the invention is preferably set at 0.05 to 0.5 weight percent.

The diecasting alloy according to the invention is well suited for the diecasting of safety components, in particular for diecasting of vehicle wheels such as car wheels for example.

The mechanical properties of the alloy according to the invention are shown in the table below. The values were determined from test rods produced from plates with 2 to 4 mm wall thickness. The ranges given show the capacity of the alloy, where restrictions are imposed according to magnesium content and wall thickness.

| Material State | Yield Strength $R_{p0,2}$ N/mm$^2$ | Tensile Strength $R_m$ N/mm$^2$ | Elongation $A_5$ % | Impact Toughness HB 5/250-30 |
|---|---|---|---|---|
| F | 120–150 | 250–290 | 5–10 | 75–95 |
| T5 | 155–245 | 275–340 | 4–9 | 90–110 |
| T4 | 95–140 | 210–260 | 12–22 | 60–75 |
| T6 | 210–280 | 290–340 | 7–12 | 100–110 |
| T7 | 120–170 | 200–240 | 15–20 | 60–75 |

Heat treatment parameters according to European standard (EN):
F = Casting state
T5 = quenched after removal from the mould and artificially aged
T4 = solution heat treated, quenched and age hardened (e.g. 144 h)
T6 = solution heat treated, quenched and artificially aged
T7 = solution heat treated, quenched and over-aged.

The alloy is characterised by a very good castability, very good corrosion resistance and excellent weldability.

What is claimed is:

1. A die casting aluminum-silicon alloy consisting essentially of:

9.5 to 11.5 weight percent silicon;

0.1 to 0.5 weight percent magnesium;

0.5 to 0.8 weight percent manganese;

up to 0.15 weight percent iron;

up to 0.03 weight percent copper;

up to 0.10 weight percent zinc;

up to 0.15 weight percent titanium;

30 to 300 ppm strontium; and balance essentially aluminum.

2. Diecasting alloy according to claim 1, wherein the strontium content lies between 50 and 150 ppm.

3. Diecasting alloy according to claim 1, wherein the alloy also contains 0.05 to 0.3 weight percent zirconium.

4. Diecasting alloy according to claim 1, wherein the alloy contains at least one of gallium phosphide and indium phosphide for grain refinement in a quantity corresponding to 1 to 250 ppm phosphorus.

5. Diecasting alloy according to claim 1, wherein the alloy for grain refinement contains titanium and boron, where the titanium and boron are added via a pre-alloy with 1 to 2 weight percent titanium and 1 to 2 weight percent boron, and the remainder aluminium.

6. Diecasting alloy according to claim 5, wherein the pre-alloy contains 1.3 to 1.8 weight percent titanium and 1.3 to 1.8 weight percent boron and the titanium/boron weight ratio lies between 0.8 and 1.2.

7. Diecasting alloy according to claim 5, wherein the alloy contains 0.05 to 0.5 weight percent pre-alloy.

8. Diecasting alloy according to claim 3, wherein the alloy contains 0.15 to 0.20 weight percent zirconium.

9. Diecasting alloy according to claim 4, wherein the alloy contains at least one of gallium phosphide and indium phosphide in a quantity corresponding to 1 to 30 ppm phosphorus.

* * * * *